US005845893A

United States Patent [19]

Groves

[11] Patent Number: 5,845,893

[45] Date of Patent: Dec. 8, 1998

[54] UNDERWATER SELF-ALIGNING FAIRLEAD LATCH DEVICE FOR MOORING A STRUCTURE AT SEA

[75] Inventor: Frank W. Groves, Solvang, Calif.

[73] Assignee: Bardex Engineering, Inc., Goleta, Calif.

[21] Appl. No.: 819,580

[22] Filed: Mar. 14, 1997

[51] Int. Cl.[6] ..... B66D 3/10; B63B 21/10

[52] U.S. Cl. ..... 254/389; 114/293; 188/65.1; 254/391; 254/415

[58] Field of Search ..... 188/65.1; 114/200, 114/293; 254/389, 390, 391, 415

[56] References Cited

U.S. PATENT DOCUMENTS

| | | | |
|---|---|---|---|
| 17,228 | 5/1857 | Osgood . | |
| 1,458,354 | 6/1923 | Neller . | |
| 2,362,531 | 11/1944 | Berger | 254/190 |
| 2,608,174 | 8/1952 | Sponenburg | 114/199 |
| 3,842,776 | 10/1974 | Wudtke | 114/206 R |
| 3,912,228 | 10/1975 | Petty et al. | 254/175.7 |
| 3,967,572 | 7/1976 | Lea | 114/206 R |
| 3,985,093 | 10/1976 | Eidem | 114/206 R |
| 4,020,779 | 5/1977 | Kitt | 114/293 |
| 4,078,768 | 3/1978 | Krogstad et al. | 254/175.7 |
| 4,430,023 | 2/1984 | Hayes et al. | 405/224 |
| 4,476,801 | 10/1984 | Foster et al. | 114/230 |
| 4,497,471 | 2/1985 | Longberg et al. | 254/372 |
| 4,513,681 | 4/1985 | Crook, Jr. | 114/293 |
| 4,722,293 | 2/1988 | Foster et al. | 114/230 |
| 4,724,789 | 2/1988 | van den Haak | 114/293 |
| 4,742,993 | 5/1988 | Montgomery et al. | 254/389 |
| 4,862,821 | 9/1989 | Ballantyne | 188/65.1 |
| 4,941,776 | 7/1990 | Bosgiraud et al. | 405/224 |
| 4,958,805 | 9/1990 | Willamsson | 254/332 |
| 5,097,788 | 3/1992 | Castel | 114/293 |
| 5,146,775 | 9/1992 | Ballard et al. | 72/447 |
| 5,149,059 | 9/1992 | Monahan | 254/394 |
| 5,178,087 | 1/1993 | O'Nion et al. | 114/230 |
| 5,390,618 | 2/1995 | Wolff et al. | 114/230 |
| 5,441,008 | 8/1995 | Lange | 114/293 |
| 5,476,059 | 12/1995 | Pollack | 114/230 |
| 5,730,425 | 3/1998 | Brooks | 254/389 |

FOREIGN PATENT DOCUMENTS

| | | |
|---|---|---|
| 2 204 818 | 8/1973 | Germany . |

OTHER PUBLICATIONS

*World Oil: Exploration, Drilling, Production,* As appeared in the Apr. and Jun. 1993 issues of *World Oil*, Reprinted from Apr. and Jun. 1993 *WORLD OIL®*.

*Primary Examiner*—Katherine Matecki
*Attorney, Agent, or Firm*—Fulbright & Jaworski; Paul E. Krieger

[57] ABSTRACT

An underwater self-aligning fairlead latch device is provided for guiding and securing an anchor chain between an offshore structure and an anchor. The fairlead device includes a latch housing pivotally mounted to a fairlead housing. The latch housing includes one or more latches for securing the anchor chain in place. The fairlead housing includes a bending shoe which guides the anchor chain from its orientation within the bending shoe up the platform column to the deck. The fairlead housing is pivotally mounted to the offshore structure.

26 Claims, 8 Drawing Sheets

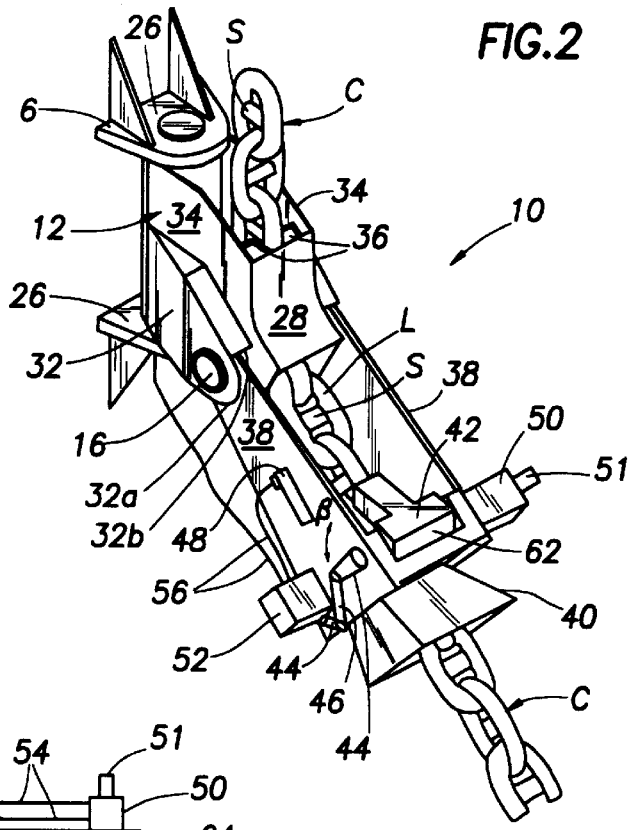
FIG.2
FIG.4
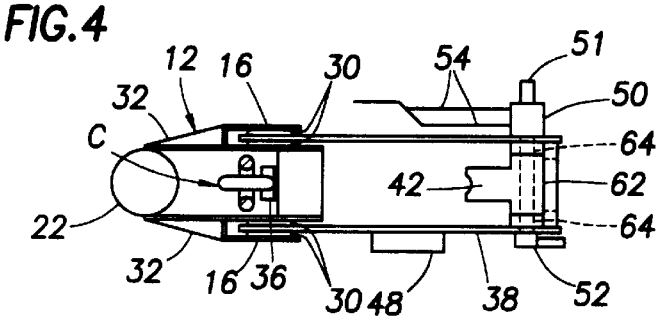
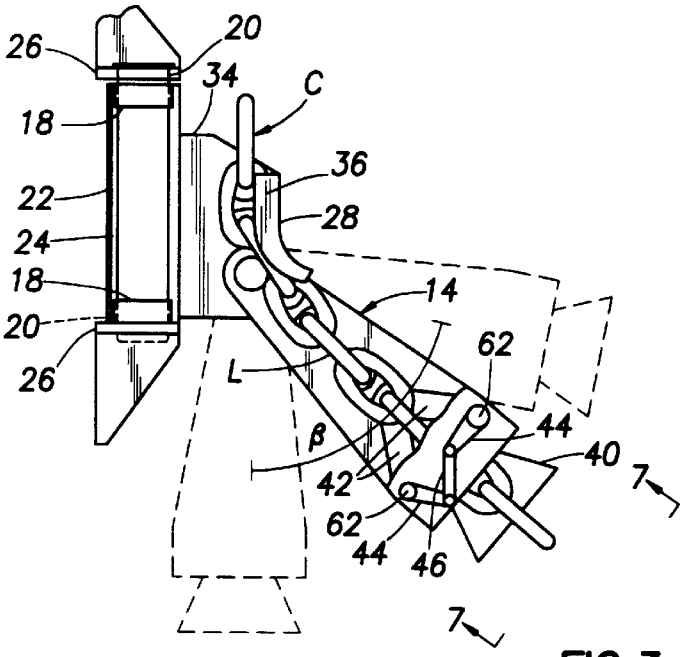
FIG.3

FIG.5
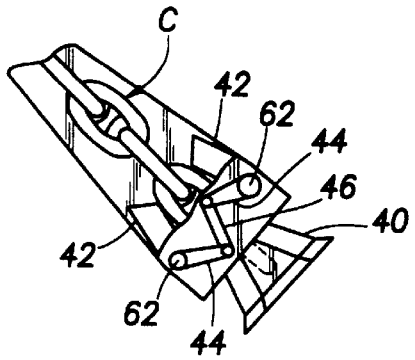
FIG.7
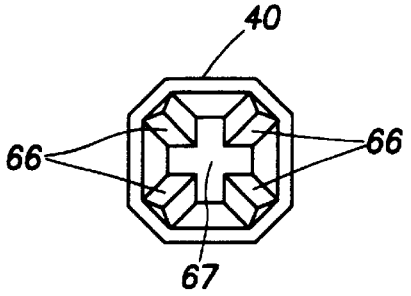
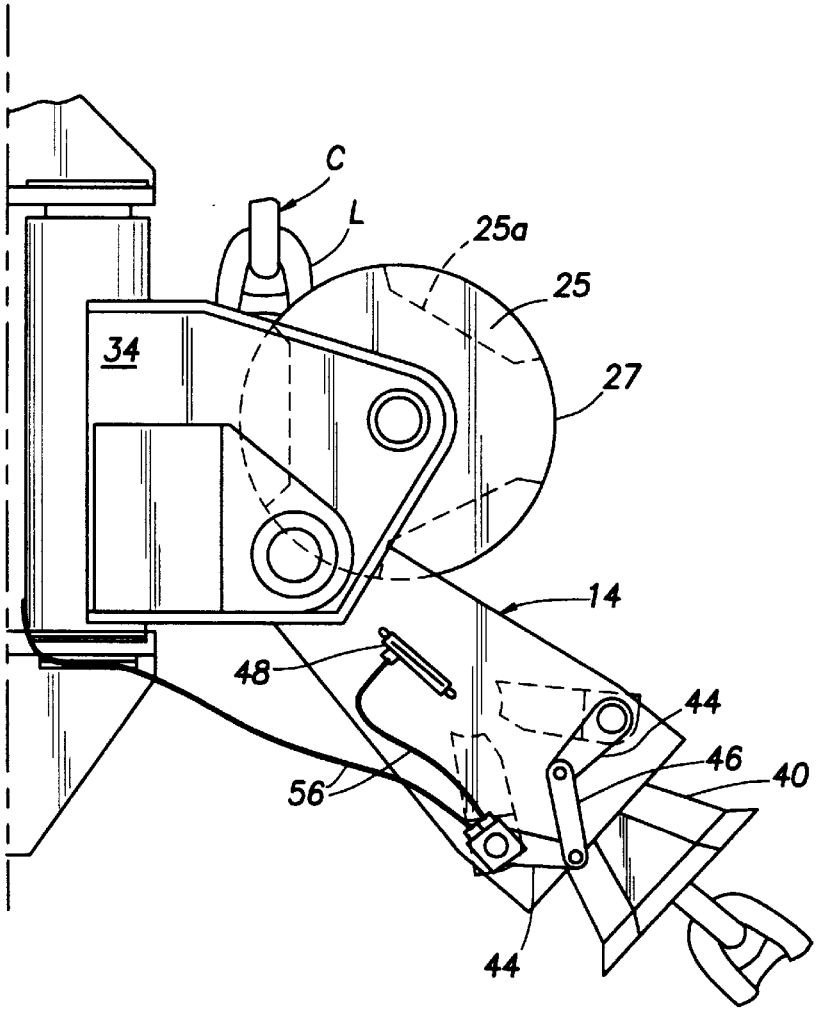
FIG.6

FIG. 14
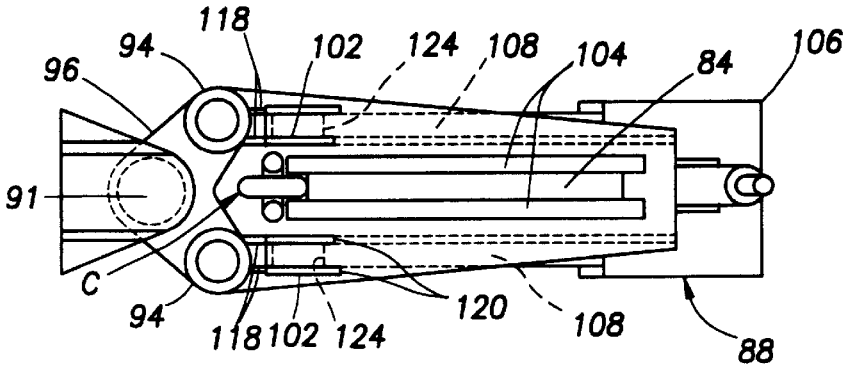
FIG. 15
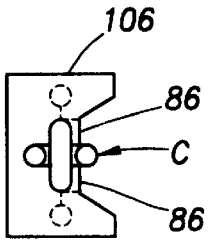
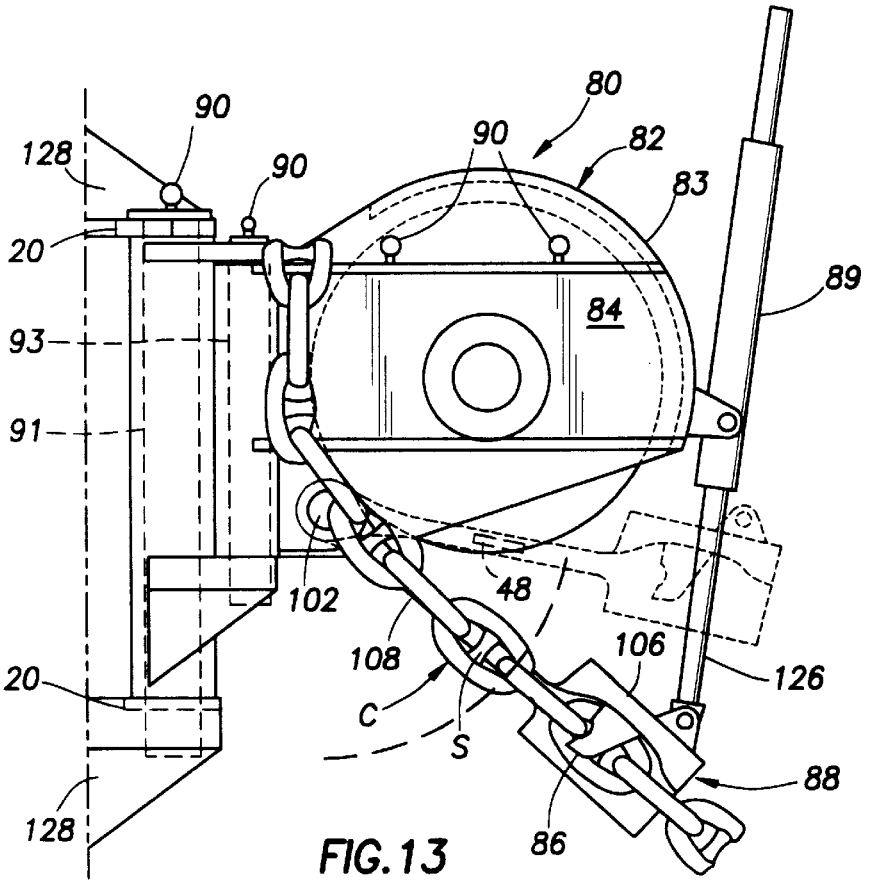
FIG. 13

UNDERWATER SELF-ALIGNING FAIRLEAD LATCH DEVICE FOR MOORING A STRUCTURE AT SEA

BACKGROUND OF THE INVENTION

1. Field of the Invention

The present invention relates to fairleads for mooring offshore structures. In particular, the present invention relates to underwater self-aligning fairlead latch devices for mooring production, drilling or construction platforms to the ocean floor.

2. Description of the Prior Art

Offshore structures, such as floating production, drilling or construction platforms or spar buoys generally are moored in a desired location through the use of chains or cables secured between the platform and anchors on the ocean floor. Typically, the practice for mooring floating platforms includes extending a chain from the ocean anchor, through a fairlead device secured to the bottom of a platform column, to chain hauling equipment and chain stopper on the deck of the platform.

Mooring platforms in place over a drilling location often require the implementation of many chains, fairlead devices, anchors and chain equipment because of the massive size of the platforms. For example, the deck area of a platform is typically large enough to hold one or more buildings for housing workers and machinery, a number of cranes, and a drilling tower or limited production facilities.

Also, floatation of platforms is typically provided by a pair of large submerged pontoons. In such structures, columns are utilized, some as large as 32 feet in diameter, to support the deck on the pontoons. As a consequence of the platform's massive structure, several fairlead devices are often secured to each column of the platform and mooring chains are run through each of the fairlead devices from the anchors to chain hauling equipment on the deck.

In a typical installation, the anchor lines are installed by passing a messenger wire rope from the deck, down through the submerged fairlead, mounted near the base of the support column, and out to a pre-installed anchor chain on the ocean floor. An end connector secures the messenger wire to the anchor chain and the anchor chain is hauled back to the platform. The anchor chain passes through the fairlead and continues up to the deck. One of the requirements of an underwater fairlead is that it be able to pass the chain itself, kenter shackles, special connecting links and the wire rope installation line. On the deck, the chain hauling equipment pretensions the chain up to a predetermined percentage of the chain breaking load and then the chain stopper or chain latch, located beneath the hauling device, locks the chain in place at the pre-tensioned load.

Once the floating platform is secured in place, anchor chains are almost continuously working due to the constant movement of the platform caused by winds, waves, tides, and currents. This constant movement of the anchor chains accelerates chain fatigue failure if the chain links engage a bending shoe or sheave that has a relatively small radius, for an extended period of time. As a result, fairlead devices are typically constructed as bending shoes or sheaves that have a relatively large radius. The sheaves used in these chain mooring applications are usually seven-pocketed wheels, also known as wildcats, which cradle the chain in pockets designed to reduce the chain stresses in the links on the wildcat.

One such device is described in U.S. Pat. No. 4,742,993 to Montgomery, et al., self-aligning quadrant fairlead is secured to a platform column. The arcuate fairlead is supported by a trunnion and bearing that enables the fairlead to swing about an upright axis for self-alignment. The current invention in its bending shoe configuration has some similarity to the Montgomery device except that the Montgomery device was designed for wire rope and did not include an underwater chain stopper.

Another device is described in U.S. Pat. No. 5,441,008 to Lange, where a submerged swivelling mooring line fairlead device is used on a structure at sea. The fairlead is rotatably mounted in a swivelling elongated rigid tube and a chain stopper is located at one end of the elongated rigid tube. The current invention differs from the Lange patent because the Lange device used a tubular body connected to a separate swivel mount and the Lange device does not permit the successful passing of the wire rope, chain, center shackles and special connectors as required by the anchor chain installation schemes which are currently in practice.

Neither the Lange nor Montgomery device can be used on the chain mooring systems currently in practice. The existing technology uses a huge, seven-pocketed wildcat underwater fairlead. During installation, a messenger wire rope is fed down from the equipment deck through the fairlead. The end of this messenger wire is connected to the pre-installed anchor chain with the aid of an anchor handling ship. The messenger wire is then hauled back in thereby pulling the wire, the special connectors and the chain through the fairlead and up to the equipment deck. At the equipment deck, the anchor chain is handed off to a massive chain hauling device which is then used to pull in additional chain catenary until the desired installation tension is reached in the chain. When this tension is reached, the chain stopper is engaged and the installation is complete.

A disadvantage of the existing fairleads is their massive size. In the current technology, the chain stopper is mounted up at the equipment deck. This means that the chain is always bearing on the underwater fairlead. These chain mooring systems are always designed for loading conditions up to the breaking strength of the chain and those links which are rounding the sheave in the underwater fairlead are subjected to high stresses in the links. The links on the sheave become the weak links of the system. In an attempt to offset this problem, the industry has recently gone from five-pocket wildcats to seven-pocket wildcats to increase the bending radius of the chain. The result has been massive size, weight and increased expense for a solution which only lessens the problem, but does not truly solve it.

The current invention completely eliminates these localized high stress and fatigue problems by taking the chain load on a stopper located between the underwater fairlead and the anchor. During installation, the maximum chain tension will typically be between 20% and 40% of the chain breaking strength. The radius of the bending shoe or the number of pockets in the wildcat can be reduced to a minimum value which does not cause over stress at the installation loads.

Another disadvantage is that when the chain stopper was stored on the deck, greater deck and column loading resulted. This condition occurred because the chain was secured to the deck through the chain stopper, which pulled down on the deck and columns. The chain stopper equipment also occupied valuable deck space and added weight to the deck.

Another disadvantage is that the submerged fairlead device is not retrievable for repair. The only means to repair the fairlead is to remove the rig from the field and take it to dry dock.

SUMMARY OF THE INVENTION

Briefly, the present invention provides an improved self-aligning fairlead latch device for mooring production, drilling, or construction platforms or spar buoys, which is more versatile than prior art devices because it has a smaller radius bending shoe and an integrated chain stopper, and is easily retrieved from its underwater installation.

The latch housing of the fairlead latch device, according to the present invention, is rotatably mounted to a fairlead housing and includes a means for securing an anchor chain at a location between the underwater fairlead and the anchor. The fairlead housing also includes a bending shoe for guiding the anchor chain during installation and is rotatably mounted to a platform column.

When hauling equipment mounted on the deck pulls an anchor chain into and through the latch housing, the anchor chain is guided through the latch housing as it is pulled into the fairlead housing. A bending shoe or sheave mounted in the fairlead housing guides the anchor chain from within the latch housing up the platform column to the deck. Once the anchor chain has reached the desired tension, the latches of the latch housing engage and secure the anchor chain in place. A very small amount of slack is then paid out by the deck hauling equipment so that the chain links on the bending shoe or the sheave are completely unloaded.

The present invention thus provides a fairlead latch device that guides and secures an anchor chain between an anchor and an offshore structure such as a production, drilling, or construction platform or spar buoy, without the need for a large radius fairlead or deck mounted chain stoppers. Further, the fairlead latch device is self-aligning and easily retrieved from its underwater installation.

BRIEF DESCRIPTION OF THE DRAWINGS

A better understanding of the present invention may be had by reference to the following drawings and contained numerals therein of which:

FIG. 2 is an isometric view of the fairlead latch mechanism of the present invention, FIG. 3 is a side elevation view, partially in section, of the fairlead latch mechanism of FIG. 2;

FIG. 4 is a top view of the fairlead latch mechanism of FIGS. 2 and 3;

FIG. 5 is a side elevation view, partially in section, of the fairlead latch mechanism of FIG. 2;

FIG. 6 is a side view, partially is section, of an alternative embodiment of the fairlead latch mechanism of the present invention;

FIG. 7 is a view taken along line 7—7 of FIG. 3;

FIG. 13 is a side view, partially in section, of the fairlead latch mechanism of FIG. 12;

FIG. 14 is a top view of the fairlead latch mechanism of FIG. 13;

FIG. 15 is a side view of the fairlead latch mechanism of FIG. 14;

DETAILED DESCRIPTION OF PREFERRED EMBODIMENT

Figure 1:
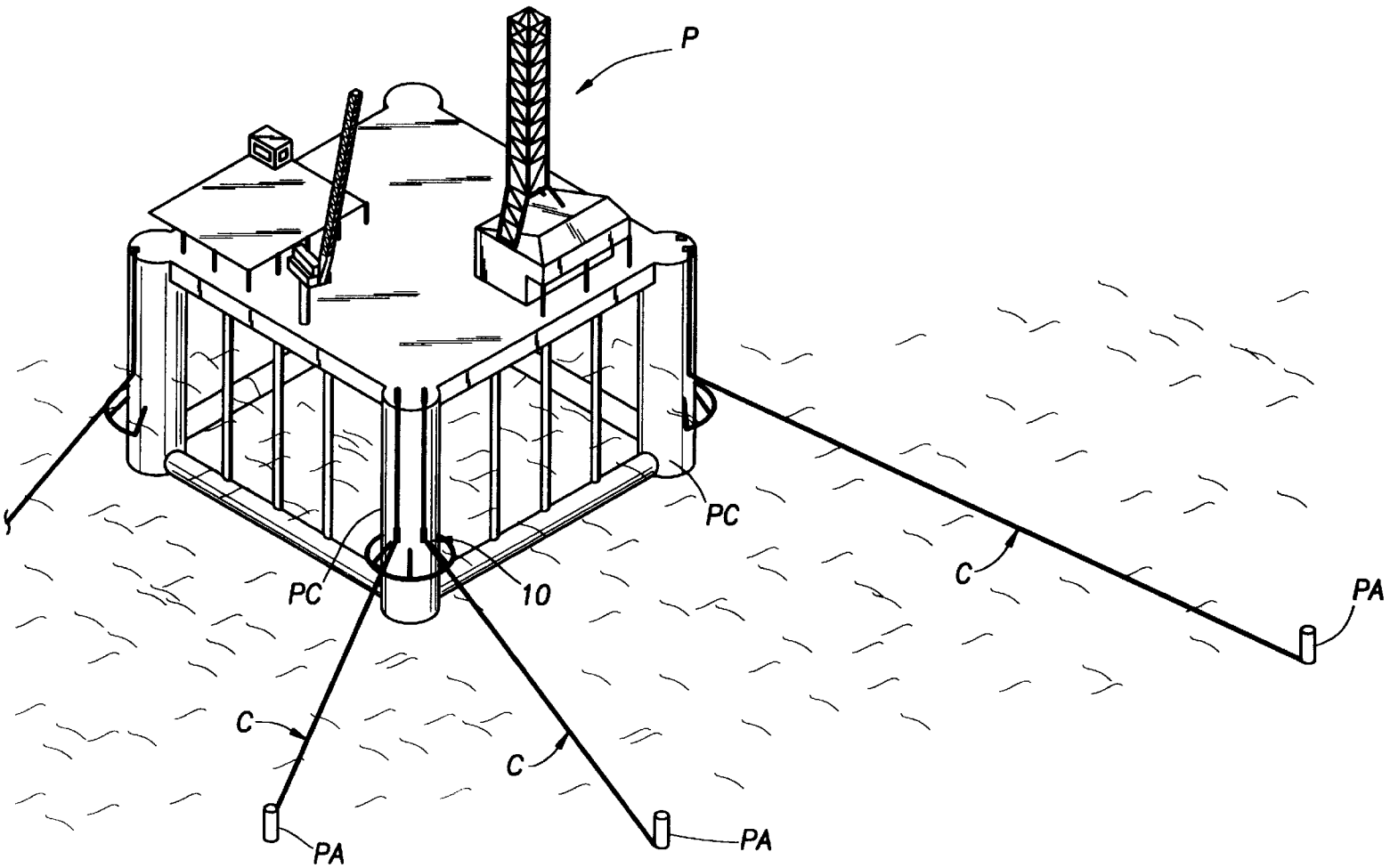
FIG. 1 is a perspective view of a typical offshore platform and a fairlead latch mechanism.

The invention relates to a fairlead latch mechanism generally designated by reference numeral 10 which can be used on floating offshore structures such as the floating offshore production platform P shown in FIG. 1. Anchor chains C stabilize and moor the platform P through connections to underwater anchors PA. Typically, the massive oil drilling or production platform requires several anchor chains C and anchors A to secure and stabilize it over the desired site. The tension in the anchor chains C prevents the platform P from drifting and pitching due to the forces of wind, tide, current, and inclement weather.

Each of the anchor chains C extends through a fairlead latch mechanism 10 which operates to guide the anchor chain C during installation and maintain the proper tension on the installed anchor chains C. As shown in FIGS. 2–4, the fairlead latch mechanism 10 includes a fairlead housing 12 and a latch housing 14. The fairlead housing 12 is pivotally mounted on a platform column PC through a pivot joint formed of a trunnion housing 22, column brackets 26, and a pair of thrust bearings 18. The pivot connection allows the fairlead housing 12 to rotate about the pivot pin 24 in order to reduce stresses between the fairlead housing 12 and the platform column PC.

The latch housing 14 is pivotally connected to the fairlead housing 12 through a clevis type pivot connection that includes a pair of pivot pins 16 and a pair of thrust bearings 30 mounted on the fairlead housing 12 in a pair of bearing brackets 32*a* and 32*b*, as best shown in FIGS. 2 and 4. The pivot connection between the fairlead housing 12 and the latch housing 14 allows the latch housing 14 to pivot relative to the fairlead housing 12, as shown by the broken lines in FIG. 3, in the direction of arrow A. The pivot pin 16 is preferably oriented perpendicularly to the pivot pin 24 in order to form a gimbled joint that provides relative movement in two planes perpendicular to each other to substantially reduce stresses imposed upon the anchor chains C and upon the platform column PC.

The anchor chains C are preferably oriented as shown in FIGS. 2–5 with the links L alternatively perpendicular and parallel to a guide surface of a bending shoe 28 mounted on the fairlead housing 12. This orientation is maintained through a pair of chain guides 36 mounted on the bending shoe 28 for engaging every other link L that is oriented perpendicular to the guide surface of the bending shoe 28. Alternatively, as shown in FIG. 6, a pocketed wildcat 27 can be used in place of the bending shoe 28 and chain guides 36. The pocketed wildcat 27 maintains the chain orientation by receiving every other link L that is oriented perpendicular to a base 25*a* of pocket 25.

A guide cone 40 is mounted on the end of the latch housing opposite the fairlead housing 12, which also maintains the orientation of the anchor chains C as described. An end view of the guide cone 40 is shown in FIG. 7 where guide plates 66 provide an opening 67 that allows the chain links L to pass through in their alternating perpendicular design. As shown in FIGS. 2 and 3, the anchor chains C have links L that include studs S that allow the links L to support large compressive stresses as the chain C passes over the bending shoe 28.

Figure 8:
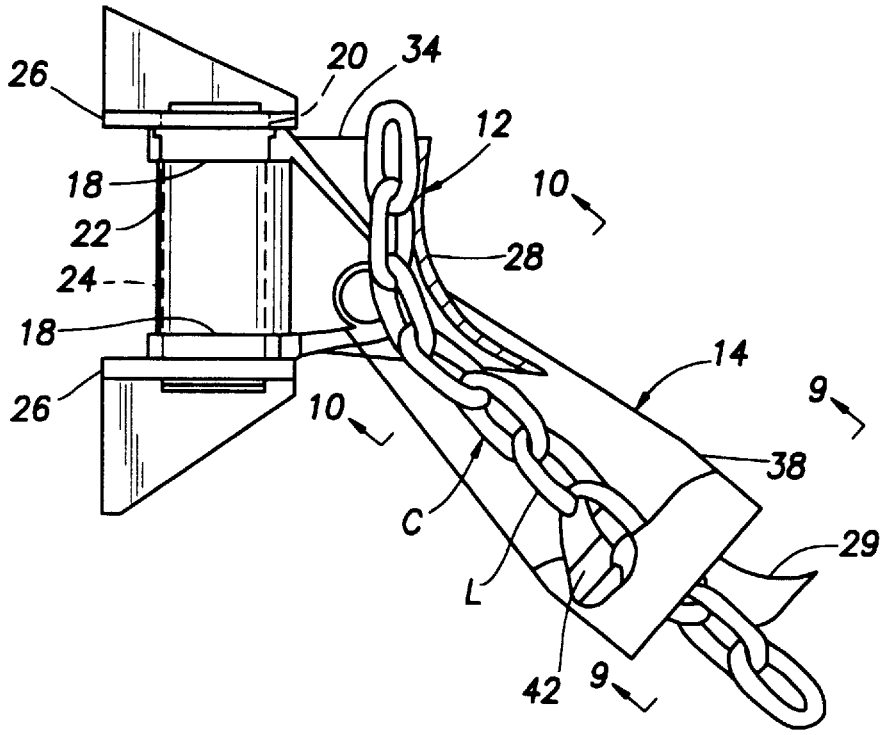
FIG. 8 is a side view, partially is section, of an alternative embodiment of the fairlead latch mechanism of the present invention.
Figure 9:
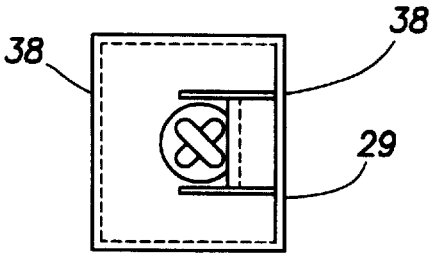
FIG. 9 is a view taken along line 9—9 of FIG. 8.
Figure 10:
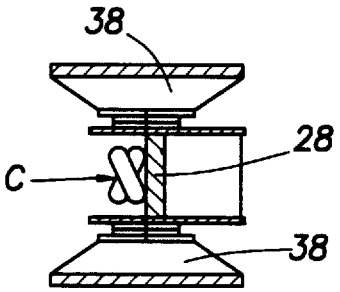
FIG. 10 is a view taken along line 10—10 of FIG. 8.
Figure 11:
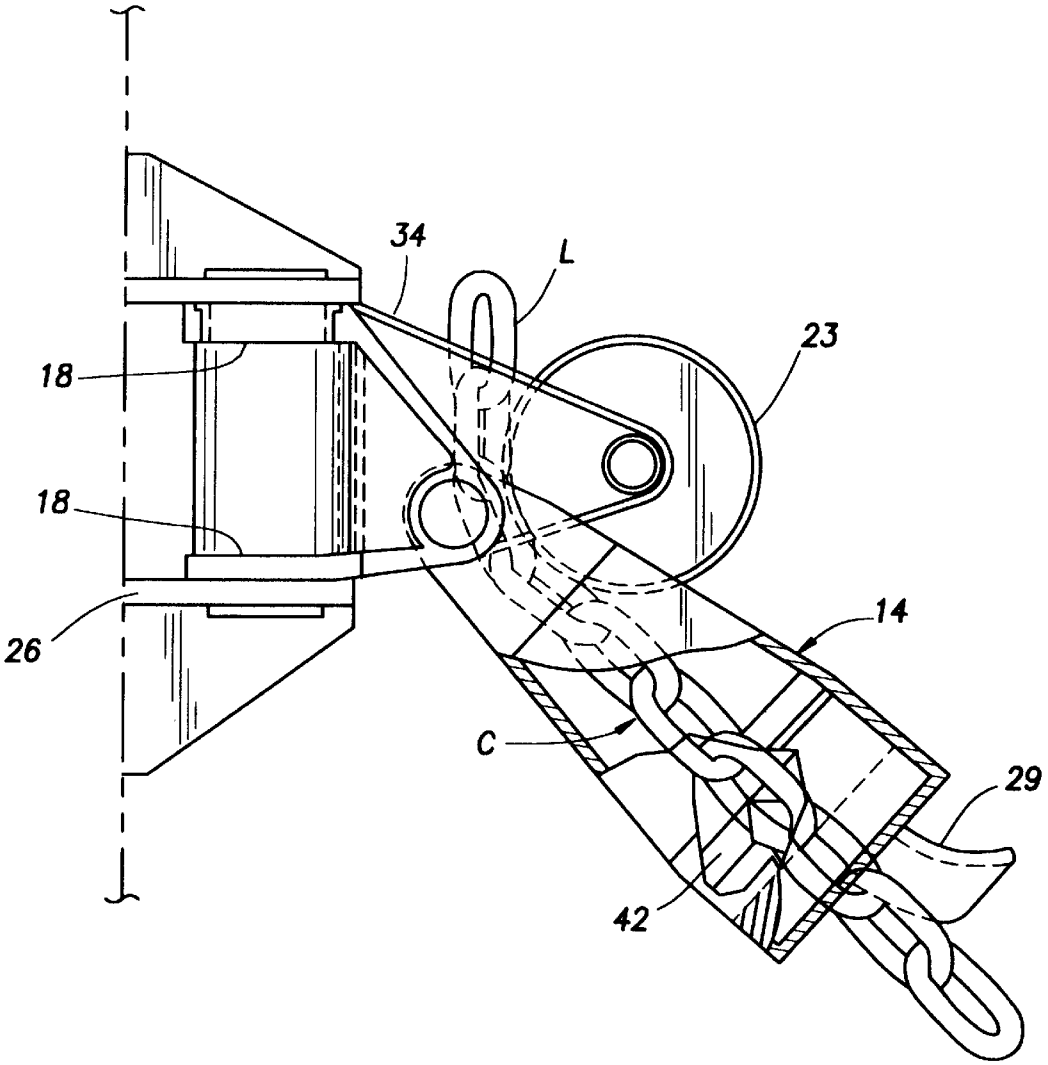
FIG. 11 is a side view, partially is section, of an alternative embodiment of the fairlead latch mechanism of the present invention.

Alternatively, the anchor chains C can be oriented as shown in FIGS. 8–10 where the fairlead latch mechanism does not include any chain guides, thus allowing the anchor chain C to be oriented in its natural position. This configuration is required in applications which employ studless chain so the chain, when it assumes its natural position, does not suffer excess stress due to the lack of a stud. The anchor chain C orientation is best shown in FIG. 10 where the ends of adjacent links engage the bearing surface of the bending shoe 28. As shown in FIG. 8, a lead shoe 29 within latch housing 14 guides the anchor chain C into the latch housing 14. The lead shoe 29 provides support for the outboard end of the latch housing 14 and thereby ensures that the latch housing 14 and the latch mechanism are located properly to the anchor chain C. Alternatively, as shown in FIG. 11, a smooth wheel or sheave 23 can be used in place of the bending shoe 28 to orient the anchor chain C in its natural position. Details of the latch mechanism for this orientation for the anchor chains C are described in greater detail below.

Referring to FIGS. 2–6, the latch housing 14 is formed with a pair of sidewalls 38 which provide an extended pathway for the anchor chain C which includes a latch mechanism for locking the chain C in place when it is properly tensioned. The latch mechanism includes a pair of latches 42 that have an end portion 62 formed with an opening through which a shaft 64 extends. The opening is square or formed with another type of irregular shape which conforms to the shape of the shaft, so that when the shaft rotates links 44 are caused to rotate as shown by the arrow B in FIG. 2. The links 44 can either be rotated manually or through a remotely operable system controlled from the surface. The remotely operable system utilizes a hydraulic cylinder 50 mounted on the latch mechanism, as shown in FIGS. 2 and 4, which is activated through hydraulic lines 54 that extend to the surface of the platform. This latch mechanism can be used for either the perpendicular/parallel chain orientation of the guided bending shoe or the natural chain orientation of the smooth bending shoe. If the smooth bending shoe is used, the latch mechanism can be rotated to a suitable angle for the latches 42 to engage the anchor chain C as described above.

The hydraulic cylinder 50 is connected to the shaft 64 and rotates the shaft to open and close the latches 42. The latches 42 synchronously move because latch links 44 are connected to one another through a latch link 46. As shown in FIGS. 2 and 3, during the anchor chain C pull-in phase, the latches 42 are hydraulically biased to such a position so as to act as a ratcheting pawl as the anchor chain C passes through the latch mechanism. To release the anchor chain C from the ratcheting latches 42, the hydraulic cylinder 50 rotates the latch mechanism to the open position, as shown in FIG. 5.

As shown in FIGS. 2 and 4, an extensiometer 48 is mounted on the latch housing 14 to measure the chain force in the anchor chain C when it is held by the latch mechanism. The extensiometer 48 provides the chain hauling equipment operator with chain load information through electric cables 56. Also, a latch position indicator 52 is attached to the shaft 64 to provide the operator with the position of latches 42 with respect to anchor chain C. The latch position is communicated to the operator through electric cables 56 which extend to the surface.

Figure 12:
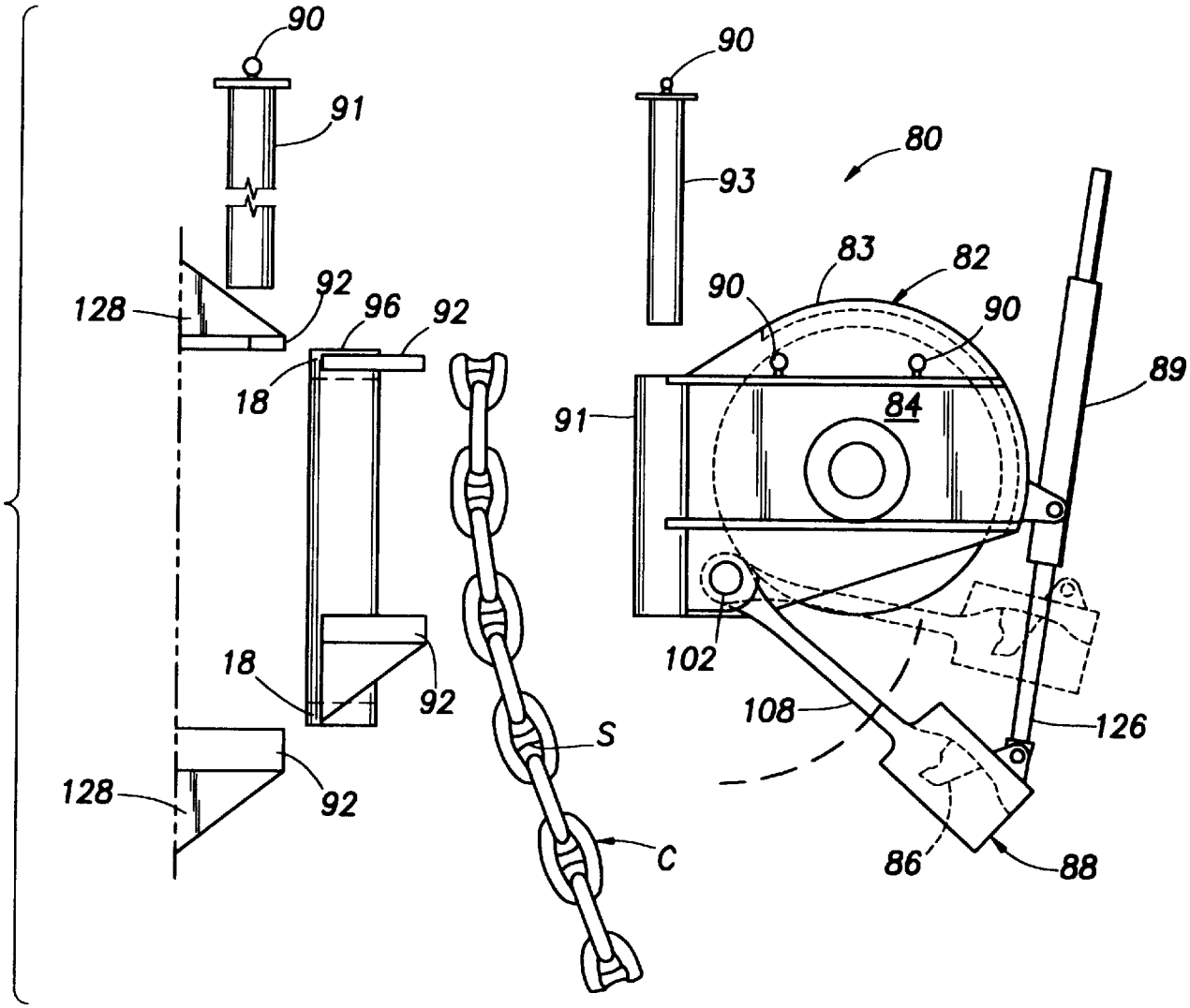
FIG. 12 is an exploded side view of an alternative embodiment of the fairlead latch mechanism of the present invention.

A variation of the chain latching mechanism is shown in FIGS. 12–17 and is generally designated by reference numeral 80. The latch housing and latches are replaced by a simple, pivoting pelican hook 88. FIGS. 12–17 also show a design which is easily retrieved from its underwater location by an operator at the water surface. As shown in FIGS. 12–15, a retrievable fairlead latch mechanism 80 is constructed of a fairlead housing 82 and a latch assembly 88. The fairlead housing 82 is pivotally mounted on a platform column PC through a pivot joint formed of a swivel bracket 96, column brackets 128, and a pair of thrust bearings 18. The pivot connection allows the fairlead housing 82 to rotate about pivot pin 91, thus reducing stresses between the fairlead housing 82 and the platform column PC. As shown in FIG. 12, the pivot pin 91 also is readily removed from the swivel bracket 96 and column brackets 128 by pulling on pivot pin 91 eye bolt 90.

Fairlead housing 82 includes a hood 83 mounted to the swivel bracket 96 through a connection formed of cylindrical collars 94 and brackets 92. The connection prevents the fairlead housing 82 from rotating about removable pins 93 but permits easy removal of the fairlead housing 82 from the swivel bracket 96. As shown in FIG. 12, the removable pins 93 are retracted from the swivel bracket 96 and cylindrical collars 94 by pulling on pivot pin 93 eye bolt 90.

The latch assembly 88 is pivotally connected to the fairlead housing 82 through a pivot connection that includes a pivot pin 102 and a pair of thrust bearings 120 mounted on the fairlead housing 82 and a pair of bearing brackets 102, as best shown in FIGS. 13 and 15. The pivot connection between fairlead housing 82 and the latch assembly 88 allows the latch assembly 88 to pivot relative to the fairlead housing 82, as shown by the broken lines in FIG. 12. Pivot pin 102 is preferably oriented perpendicular to the pivot pin 91 in order to form a gimbled joint that provides relative movement in two planes perpendicular to each other to substantially reduce stresses imposed upon the anchor chains C and upon the platform column PC.

The anchor chains C are preferably oriented as shown in FIGS. 13–15 with the links L alternatively perpendicular and parallel to a guide surface of a rotatable sheave 84 mounted within the fairlead housing 82. This orientation is maintained through a pair of chain guides 104 mounted on the rotatable sheave 84 for engaging every other link that is oriented perpendicular to the guide surface of the rotatable sheave 84. As is commonly known in the art, the rotatable sheave 84 may be a pocketed, a grooved, or a combination wildcat. As can be appreciated, the rotatable sheave 84 can be nonrotating or replaced with a bending shoe like those described above.

Figure 17:
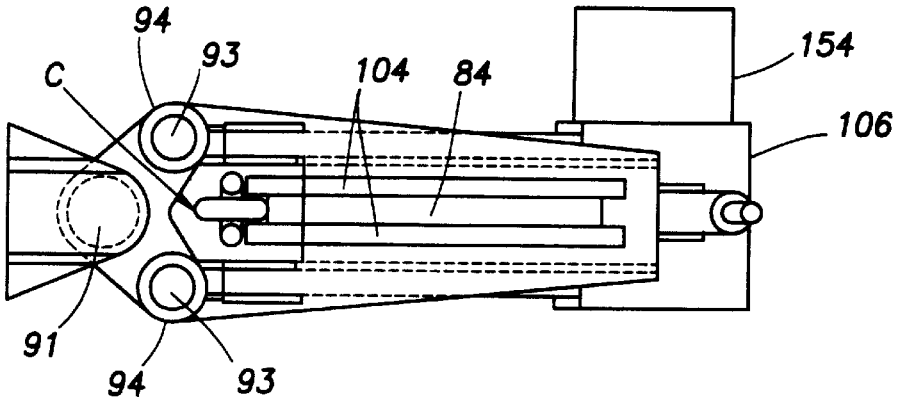
FIG. 17 is a top view of the fairlead latch mechanism of FIG. 16.
Figure 16:
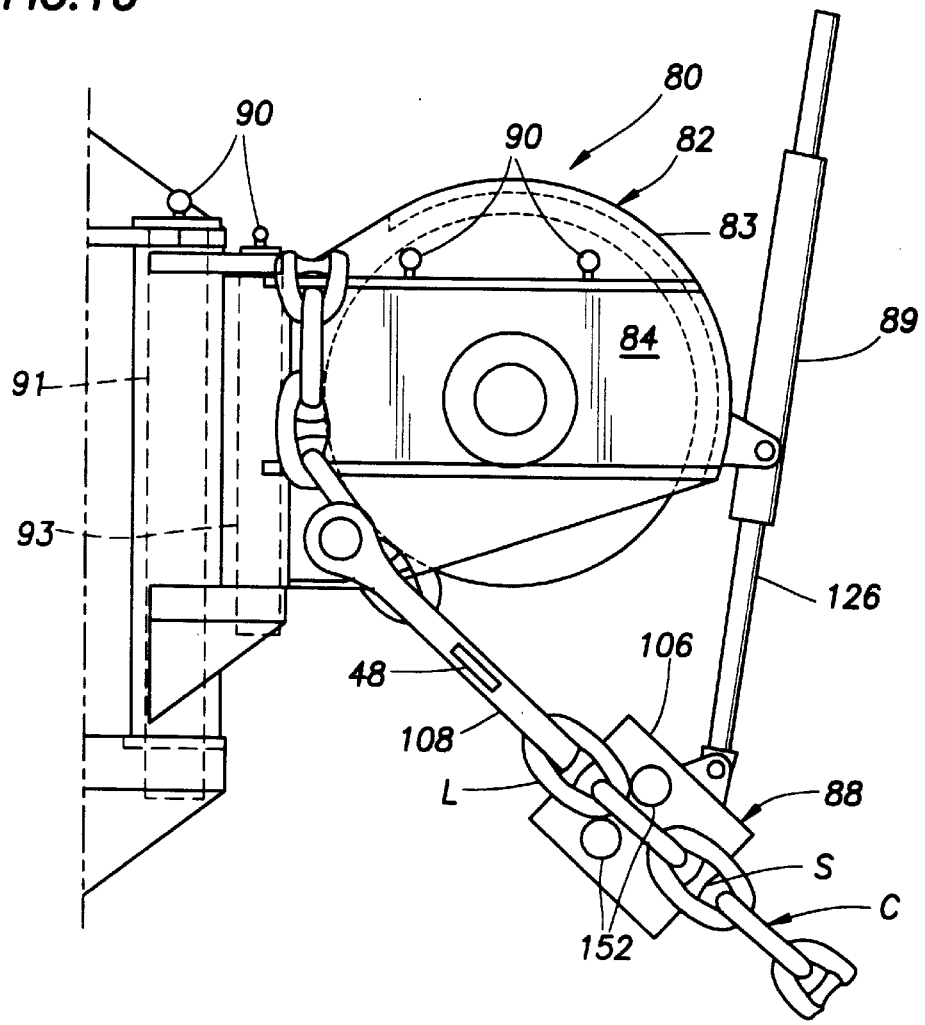
FIG. 16 is a side view, partially in section, of an alternative embodiment of the fairlead latch mechanism of the present invention.

Referring to FIGS. 12–14, the latch assembly 88 is formed with a pair of arms 108 to provide an extended pathway for the anchor chains C and includes a latch mechanism for locking the anchor chains C in place when properly tensioned. The latch mechanism includes a pair of pelican hooks 86 attached to channel 106. The pelican hooks 86 are moved into and out of engagement with chain links L by arm 126 extending and retracting through hydraulic cylinder 89 mounted on the fairlead housing 82, as shown in FIG. 13. The hydraulic cylinder 89 is pivotally mounted to the fairlead housing 82 and to the channel 106. After the pelican hooks 86 engage the chain links L, the hydraulic cylinder 89 is deactivated to permit free translation of arm 126 within the hydraulic cylinder 89 resulting in the free rotation of the latch assembly 88 about pins 102. Although not shown, the hydraulic cylinder 89 is activated through hydraulic lines that extend to the surface. As shown in FIGS. 16 and 17, the latch mechanism can include retractable pins 152 which extend and retract from hydraulic actuator 154 to lock the anchor chain C at the desired tension. Like the hydraulic cylinder 89, the hydraulic actuator 154 is controlled from the surface through hydraulic lines (not shown).

One of the benefits of the latch assembly 88 is that during pull in and pay out of the anchor chain C, the hydraulic cylinder 89 retracts arm 126 and the latch mechanism, as shown in the dotted lines of FIG. 12. The retracted latch mechanism allows the anchor chain C to be pulled in without obstruction or interference from the latch mechanism.

A benefit of fairlead latch mechanism 80 is that it can be readily retrieved to the surface by the removal of pivot pin 91 or removable pins 93. As shown in FIGS. 12, 13, and 16, after the appropriate pins have been removed, the fairlead housing 82 and the latch assembly 88 can be retrieved by pulling up on fairlead housing 82 eye bolts 90.

The foregoing disclosure and description of the invention is illustrative and explanatory thereof, and various changes in the size, shape, and materials as well as in the details of illustrative construction and assembly, may be made without departing from the spirit of the invention.

What is claimed is:

1. A fairlead latch mechanism for guiding and securing an anchor chain between an offshore structure and an anchor, the fairlead latch mechanism comprising:

a fairlead housing pivotally mounted to the offshore structure, wherein said fairlead housing includes a fixed bending shoe;

a latch housing pivotally mounted to said fairlead housing, wherein said latch housing extends toward the anchor;

a latch mechanism mounted to said latch housing, wherein said latch mechanism includes a ratchet assembly; and an actuator for operating said ratchet assembly.

2. The fairlead latch mechanism according to claim 1, wherein said bending shoe includes a chain guide.

3. The fairlead latch mechanism according to claim 1, wherein said ratchet assembly includes at least two latches rotatably mounted within said latch housing.

4. The fairlead latch mechanism according to claim 3, wherein said ratchet assembly includes an hydraulic actuator for operating said latches.

5. The fairlead latch mechanism according to claim 3, wherein said ratchet assembly includes a manual system for operating said latches.

6. The fairlead latch mechanism according to claim 3, wherein a plurality of links connect said latches.

7. The fairlead latch mechanism according to claim 1, wherein said latch housing includes an instrumentation system for measuring tension in the anchor chain.

8. The fairlead latch mechanism according to claim 1, wherein said latch mechanism includes a latch position indicator sensor.

9. The fairlead latch mechanism according to claim 1, wherein said latch housing includes a lead shoe for orienting the anchor chain within said latch housing.

10. A fairlead latch mechanism for guiding and securing an anchor chain between an offshore structure and an anchor, the fairlead latch mechanism comprising:

a fairlead housing pivotally mounted to the offshore structure, wherein said fairlead housing includes a rotatable sheave;

a latch housing pivotally mounted to said fairlead housing, wherein said latch housing extends toward the anchor;

a latch mechanism mounted to said latch housing, wherein said latch mechanism includes a ratchet assembly; and an actuator for operating said ratchet assembly.

11. The fairlead latch mechanism according to claim 10, wherein said rotatable sheave includes a pocketed wildcat.

12. The fairlead latch mechanism according to claim 10, wherein said ratchet assembly includes at least two latches rotatably mounted within said latch housing.

13. The fairlead latch mechanism according to claim 12, wherein said ratchet assembly includes an hydraulic actuator for operating said latches.

14. The fairlead latch mechanism according to claim 12, wherein said ratchet assembly includes a manual system for operating said latches.

15. The fairlead latch mechanism according to claim 12, wherein a plurality of links connect said latches.

16. The fairlead latch mechanism according to claim 10, wherein said latch housing includes an instrumentation system for measuring tension in the anchor chain.

17. The fairlead latch mechanism according to claim 10, wherein said latch mechanism includes a latch position indicator sensor.

18. The fairlead latch mechanism according to claim 10, wherein said latch housing includes a lead shoe for orienting the anchor chain within said latch housing.

19. A fairlead latch mechanism for guiding and securing an anchor chain between an offshore structure and an anchor, the fairlead latch mechanism comprising:

a fairlead housing pivotally mounted to the offshore structure, wherein said fairlead housing includes a rotatable sheave;

a latch mechanism pivotally mounted to said fairlead housing, wherein said latch mechanism extends toward the anchor and includes an arm slidably mounted within an actuator; and a pair of hooks attached to said arm for engaging the anchor chain.

20. The fairlead latch mechanism according to claim 19, wherein said fairlead housing is detachably mounted to the offshore structure by means of a pin inserted into a trunnion housing of said fairlead housing.

21. The fairlead latch mechanism according to claim 19, wherein said rotatable sheave includes a chain guide.

22. The fairlead latch mechanism according to claim 19, wherein said latch mechanism includes an instrumentation system for measuring tension in the anchor chain.

23. A fairlead latch mechanism for guiding and securing an anchor chain between an offshore structure and an anchor, the fairlead latch mechanism comprising:

a fairlead housing pivotally mounted to the offshore structure, wherein said fairlead housing includes a rotatable sheave;

a latch mechanism pivotally mounted to said fairlead housing, wherein said latch mechanism extends toward the anchor and includes an arm slidably mounted within a first actuator; and a second actuator mounted to said arm, wherein said second actuator includes a pair of extendable pins for engaging the anchor chain.

24. The fairlead latch mechanism according to claim 23, wherein said fairlead housing is detachably mounted to the offshore structure by means of a pin inserted into a trunnion housing of said fairlead housing.

25. The fairlead latch mechanism according to claim 23, wherein said rotatable sheave includes a chain guide.

26. The fairlead latch mechanism according to claim 23, wherein said latch mechanism includes an instrumentation system for measuring tension in the anchor chain.

* * * * *